US005633567A

United States Patent [19]

Spanjer

[11] Patent Number: 5,633,567

[45] Date of Patent: May 27, 1997

[54] DISPLAY DEVICE AND CATHODE RAY TUBE

[75] Inventor: Tjerk G. Spanjer, Eindhoven, Netherlands

[73] Assignee: U.S. Philips Corporation, New York, N.Y.

[21] Appl. No.: 434,104

[22] Filed: May 3, 1995

[30] Foreign Application Priority Data

May 6, 1994 [EP] European Pat. Off. ..... 94201264

[51] Int. Cl.[6] ..... H01J 29/58

[52] U.S. Cl. ..... 315/382.1; 313/414; 313/449

[58] Field of Search ..... 315/382, 382.1, 315/16; 313/414, 449

[56] References Cited

U.S. PATENT DOCUMENTS 5,055,749 10/1991 Chen et al. ..... 315/368

5,061,881 10/1991 Suzuki et al. ..... 315/382

5,241,237 8/1993 Misono et al. ..... 315/382

5,404,071 4/1995 Son ..... 313/414

FOREIGN PATENT DOCUMENTS 0509590 10/1992 European Pat. Off. ..... H01J 29/50

*Primary Examiner*—Theodore M. Blum

*Attorney, Agent, or Firm*—Robert J. Kraus; Bernard Franzblau

[57] ABSTRACT

A cathode ray tube in which the pre-focusing field, the main lens field, a quadripolar field in the pre-focusing portion of the electron gun and a quadripolar field in the main lens are dynamically varied by means of only one dynamic voltage.

15 Claims, 3 Drawing Sheets

DISPLAY DEVICE AND CATHODE RAY TUBE

BACKGROUND OF THE INVENTION

This invention relates to a display device having a cathode ray tube which comprises a display screen and a deflection unit for deflecting electron beams, the cathode ray tube containing an in-line electron gun which includes a main lens portion having means for generating a main lens field and a quadripolar field, the display device having means for dynamically varying the intensity of the main lens field and the quadripolar field, the electron gun having means for generating, in front of the main lens field, a pre-focusing lens field and a further quadripolar field, and the display device having means for dynamically varying the intensity of the pre-focusing field and the further quadripolar field.

The invention also relates to a cathode ray tube which can suitably be used in a display device.

Display devices are used, inter alia, in TV receivers and colour monitors.

A display device of the type mentioned in the opening paragraph, and a cathode ray tube which can suitably be used in such a display device are known from European Patent Application EP-509590, which corresponds to U.S. Pat. No. 5,347,202.

In operation, the deflection unit generates an electromagnetic field for deflecting electron beams across a display screen. These electron beams are generated in the electron gun. The deflection field has a refocusing effect on the electron beams and causes astigmatism. These effects vary with the degree of deflection. The electron gun comprises means for generating a main lens field and a quadripolar field, and the display device includes means for dynamically varying the intensity of said main lens field and quadripolar field. By virtue thereof, astigmatism and focusing of the electron beams can be controlled as a function of the deflection in such a manner such that astigmatism caused by the deflection field is at least partially compensated for and focusing is at least substantially constant across the display screen. This has a positive effect on picture reproduction. In the literature, such electron guns are also referred to as DAF guns (Dynamic-Astigmatism and Focusing). To preclude disturbing Moiré effects, particularly at the edges of the display screen, the display device known from EP-A-509590 comprises means for generating a dynamic pre-focusing field and a dynamic, further quadripolar field. In particular very small vertical spot dimensions at the edges of the display screen can be precluded. In the known display device, the dynamic pre-focusing field and the dynamic, further quadripolar field together constitute a dynamic cylindrical lens, which influences the beam diameter in the vertical direction, but has almost no influence in the horizontal direction. Within the scope of the invention, the term "quadripolar field" is to be understood to mean an electric field having a quadripolar component.

SUMMARY OF THE INVENTION

In general, the aim is to simplify the display device as much as possible. It is an object of the invention to provide a simplified display device of the type mentioned in the opening paragraph.

To this end, the display device in accordance with the invention is characterized in that, in operation, the intensity of said four fields is dynamically varied by means of only one dynamic voltage.

In the known display device, two dynamic voltages are used, i.e. one voltage for the main lens field and the quadripolar field ($V_{dyn}$) and one voltage for the pre-focusing lens field and the further quadripolar field ($V''_{dyn}$). The use of only one dynamic voltage instead of two makes it possible to simplify the drive.

For example, in operation, the amplitude of the dynamic voltage of a 90° tube is below 700 volts, and preferably ranges between approximately 500 and 200 volts. In the case of 110° tubes, the amplitude preferably ranges between 1 and 2 kV.

In the known display device, the dynamic pre-focusing field and the dynamic, further quadripolar field together constitute a dynamic cylindrical lens. As experiments carried out within the scope of the invention revealed, this has the disadvantage that a dynamic voltage having a relatively large amplitude is required to attain this effect. For example, in a 90° tube, an amplitude of 2 kV is required. As the amplitude of the dynamic voltage is larger, a larger power supply is required. In addition, the losses and the problems caused by capacitive coupling increase. They comply with $fCV^2$, wherein f is the frequency, C is the capacitance and V is the amplitude. Said problems can be reduced by using lower dynamic voltages.

In a perfect dynamic cylindrical lens, as known from EP 509 590, the intensities of the dynamic quadripole and the dynamic pre-focusing lens in the horizontal direction are equal in magnitude and of opposite sense. In the vertical direction, the two dynamic lenses intensify each other, in the horizontal direction they compensate each other. The invention is, inter alia, based on the insight that a slight variation of the horizontal beam diameter is permitted since this does not directly lead to an undesirable extra growth of the spot reproduced on the display screen. For this reason, use can be made of an imperfect cylindrical lens which also exhibits some lens action in the horizontal direction. The vertical lens action is increased by intensifying the quadripolar lens, i.e. in an embodiment the length-width ratio of rectangular holes in an electrode is increased. By virtue thereof, the same amplitude (for example, for a 90° tube, below 700 V and preferably between 500 and 200 V) can be used as for the DAF effect. Also in this case, a change of the horizontal beam diameter occurs but, as stated above, this does not necessarily have a substantial effect on the spot size. The amplitude preferably ranges between 500 and 200 volts because these are customary amplitudes for the dynamic voltage used to drive the dynamic main lens field. By virtue thereof, a substantial change in the construction of the main lens field of the electron gun is not necessary.

The ratio of the quotient of the change of the beam diameter in the horizontal direction (dBx) as a function of the dynamic voltage ($V_{dyn}$) to the quotient of the change of the beam diameter in the vertical direction (dBy) as a function of the dynamic voltage, taking account only of the influence of the dynamic voltage on the pre-focusing field and the further quadripolar field, preferably complies with:

$$-0.6 \leqq dBx/V_{dyn}: dBy/V_{dyn} \leqq 0$$

The dynamic voltage causes the beam diameter to vary slightly in the horizontal direction as a result of the variation of the intensity of the combination of the pre-focusing field and the further qaudripolar field, but this variation of the beam diameter is such that it does not clearly influence the reduction of the Moiré effects. For the purpose of comparison, this ratio is assumed to be 0.0 for an ideal dynamic cylindrical lens, 1 for an ideal dynamic "round" lens and −1 for an ideal dynamic quadripolar lens.

Preferably, $dBx/V_{dyn}$: $dBy/V_{dyn}$ ranges between −0.2 and −0.6.

A further aspect of the invention is that a cathode ray tube having an electron gun which comprises an in-line electron gun which contains three cathodes, a first ($G_1$), a second ($G_2$), a third ($G_3$) and a fourth electrode ($G_4$), the third electrode comprising a first, a second and a third sub-electrode ($G_{3a}$, $G_{3b}$, $G_{3c}$), and, in operation, a main lens being formed between the fourth electrode ($G_4$) and the third sub-electrode ($G_{3c}$), a quadripolar lens being formed between the third sub-electrode ($G_{3c}$) and the second sub-electrode ($G_{3b}$), a further quadripolar lens being formed between the second sub-electrode ($G_{3b}$) and the first sub-electrode ($G_{3a}$), and a pre-focusing lens being formed by the first sub-electrode ($G_{3a}$), the second electrode ($G_2$) and the first electrode ($G_1$), is characterized in that the display device comprises means for applying an equal dynamic voltage to the first and third sub-electrodes and a focusing voltage to the second sub-electrode.

In operation, the ratio of the quotient of the change of the beam diameter in the horizontal direction (dBx) as a function of the dynamic voltage ($V_{dyn}$) to the quotient of the change of the beam diameter in the vertical direction (dBy) as a function of the dynamic voltage, account being taken only of the influence of the dynamic voltage on the pre-focusing field and the further quadripolar field, preferably complies with:

$$-0.6 \leqq dBx/V_{dyn}: dBy/V_{dyn} \leqq 0$$

This can be achieved in a simple manner by providing the facing sides of the first and second sub-electrodes with elongated, for example rectangular, oval or elliptical apertures, the length:width ratio of these apertures being in excess of 1.5. In an embodiment, the three apertures in the second sub-electrode are combined to form one large elongated aperture. In the cathode ray tube disclosed in EP 509 590, said ratio is 1.25. By increasing said ratio, the vertical lens action is increased as a result of which a smaller amplitude of the dynamic voltage is required. Preferably, $dBx/V_{dyn}$:$dBy/V_{dyn}$ ranges between −0.6 and −0.2.

It is noted that British Patent Application GB 2 236 613 discloses a cathode ray tube having a main lens in front of which a quadripolar field, a pre-focusing lens and a further quadripolar field are arranged, the intensity of said main lens field, said quadripolar field and said further quadripolar field being controlled by means of a dynamic voltage. From an electron-optical point of view, the invention differs from this prior art in that, in the latter, the pre-focusing field formed by electrodes G1, G2 and G3 is not dynamically varied (the above-mentioned ratio $dBx/V_{dyn}$:$dBy/V_{dyn}$ thus corresponds to the value of a substantially ideal quadripolar field (=−1)). From a constructional point of view, the invention differs from the prior art in that, in the latter, one extra sub-electrode is required ($G_{3a}$ is divided into two sub-electrodes between which a potential difference is applied). The use of an extra electrode means that the construction of the electron gun is more complicated.

BRIEF DESCRIPTION OF THE DRAWINGS

These and other aspects of the invention will be described in greater detail by means of an example and with reference to the accompanying drawing, in which.

The Figures are not drawn to scale. In the Figures, corresponding parts generally bear the same reference numerals.

DESCRIPTION OF THE PREFERRED EMBODIMENTS

Figure 2:
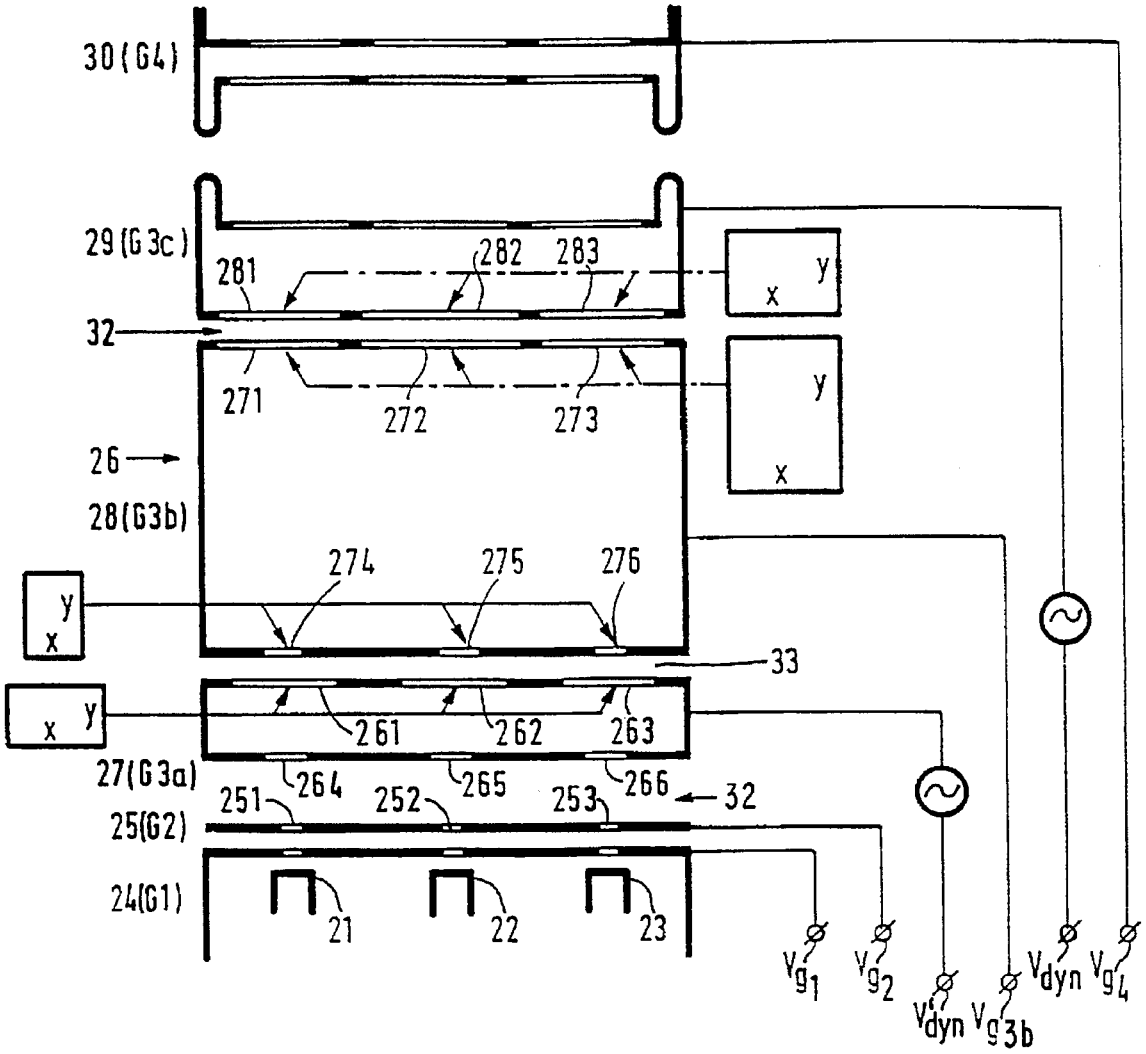
FIG. 2 is a sectional view of an electron gun.

The display device comprises a cathode ray tube, in this example colour display tube 1, having an evacuated envelope 2 which consists of a display window 3, a cone portion 4 and a neck 5. In the neck 5 there is provided an electron gun 6 for generating three electron beams 7, 8 and 9 which extend in one plane, the in-line plane which in this case is the plane of the drawing. A display screen 10 is provided on the inside of the display window. Said display screen 10 comprises a large number of phosphor elements luminescing in red, green and blue. On their way to the display screen, the electron beams are deflected across the display screen 10 by means of an electromagnetic deflection unit 11 and pass through a colour selection electrode 12 which is arranged in front of the display window 3 and which comprises a thin plate with apertures 13. The colour selection electrode is suspended in the display window by means of suspension elements 14. The three electron beams 7, 8 and 9 pass through the apertures 13 of the colour selection electrode at a small angle with each other, so that each electron beam impinges on phosphor elements of only one colour. The display device further comprises means 15 for generating, in operation, voltages which are applied, via feedthroughs 16, to components of the electron gun. FIG. 2 is a sectional view of an electron gun. Said electron gun comprises three cathodes 21, 22 and 23. It further comprises a first common electrode 24 ($G_1$), a second common electrode 25 ($G_2$), a third common electrode 26 ($G_3$) which comprises a first common sub-electrode 27 ($G_{3a}$), a second common sub-electrode 28 ($G_{3b}$) and a third common sub-electrode 29 ($G_{3c}$), and a fourth common electrode 30 ($G_4$). The electrodes have connections for applying voltages. The display device comprises an electrical lead, not shown, for applying voltages, generated in the means 15, to the electrodes. By applying voltages and, in particular, by voltage differences between electrodes and/or sub-electrodes, electron-optical fields are generated. Electrodes 30 ($G_4$) and sub-electrode 29 ($G_{3c}$) constitute an electron-optical element for generating a main lens field which, in operation, is formed between these electrodes. Sub-electrodes 29 ($G_{3c}$) and 28 ($G_3$) form an electron-optical element for generating a quadripolar field which, in operation, is formed between the electrodes. Within the scope of the invention, the term "quadripolar field" is to be understood to mean an electric field having a quadripolar component. Dependent upon, inter alia, the shape of the apertures, for example, the length-width ratio of the apertures, the generated electric field may comprise, in addition to the quadripolar component, a dipolar component and, possibly, higher-order (six, eight, ten, etc.) components. The cathodes and the electrodes 24 and 25 constitute the so-called triode portion of the electron gun. Electrode 25 ($G_2$) and sub-electrode 27 ($G_{3a}$) constitute an electron-optical element for generating a pre-focusing field approximately in space 32 between these electrodes. Electrodes 27 ($G_{3a}$) and 28 ($G_{3b}$) constitute an electron-optical element for generating a quadripolar field in space 33. All electrodes have apertures for allowing passage of the electron beams. In this example, apertures 281,282 and 283 are rectangular, as are apertures 291,292 and 293. This is schematically shown next to the Figures. Apertures 274, 275 and 276, and apertures 261,262 and 263 are also rectangular.

FIG. 2 schematically shows an electron gun in accordance with the state of the art. In operation, a dynamic potential $V_{dyn}$ is applied to sub-electrode 29 ($G_{3c}$). The electron beams are deflected across the display screen by the deflection unit. The electro-magnetic field responsible for this deflection also has a focusing effect, due to which it causes astigmatism which is governed by the deflection angle of the electrons. The dynamic voltage $V_{dyn}$ varies as a function of the deflection angle. By virtue thereof, astigmatism caused by the electro-magnetic deflection field can be largely compensated for. Disturbing effects may occur at the edges of the display screen. So-called Moiré effects may occur. One of the most important causes of these problems is that very small vertical spot dimensions may occur at the edges of the display screen, the so-called vertical spot shrinkage. To preclude these effects, EP 509591 proposes an electron gun which comprises a pre-focusing portion having a dynamic cylindrical lens. In operation, a dynamic pre-focusing lens is formed between electrode 25 ($G_2$) and sub-electrode 27 ($G_{3a}$), which undergoes an equal change in the horizontal and vertical directions as a function of a dynamic potential $V_{dyn}$. In operation, a quadripolar field is generated between the sub-electrodes 27 ($G_{3a}$) and 28 ($G_{3b}$). The apertures are selected so that the effect of a dynamic change of the potential $V'_{dyn}$ on an electron beam as a result of the quadripolar field increases the effect of the dynamic pre-focusing lens in the vertical direction, so that the vertical spot shrinkage is reduced and compensates for said effect in the horizontal direction, as a result of which little or no change in the horizontal spot dimension takes place. Voltages $V_{G1}$, $V_{G2}$, $V_{G3b}$ and $V_{G4}$ are applied to, respectively, the electrodes $G_1$, $G_2$, $G_{3b}$ and $G_4$. A disadvantage of this device is that two different dynamic voltages ($V_{dyn}$ and $V'_{dyn}$ are necessary. This requires two different drive voltages. In general, the aim is to simplify the display device as much as possible. It is an object of the invention to provide a simplified display device.

Figure 3:
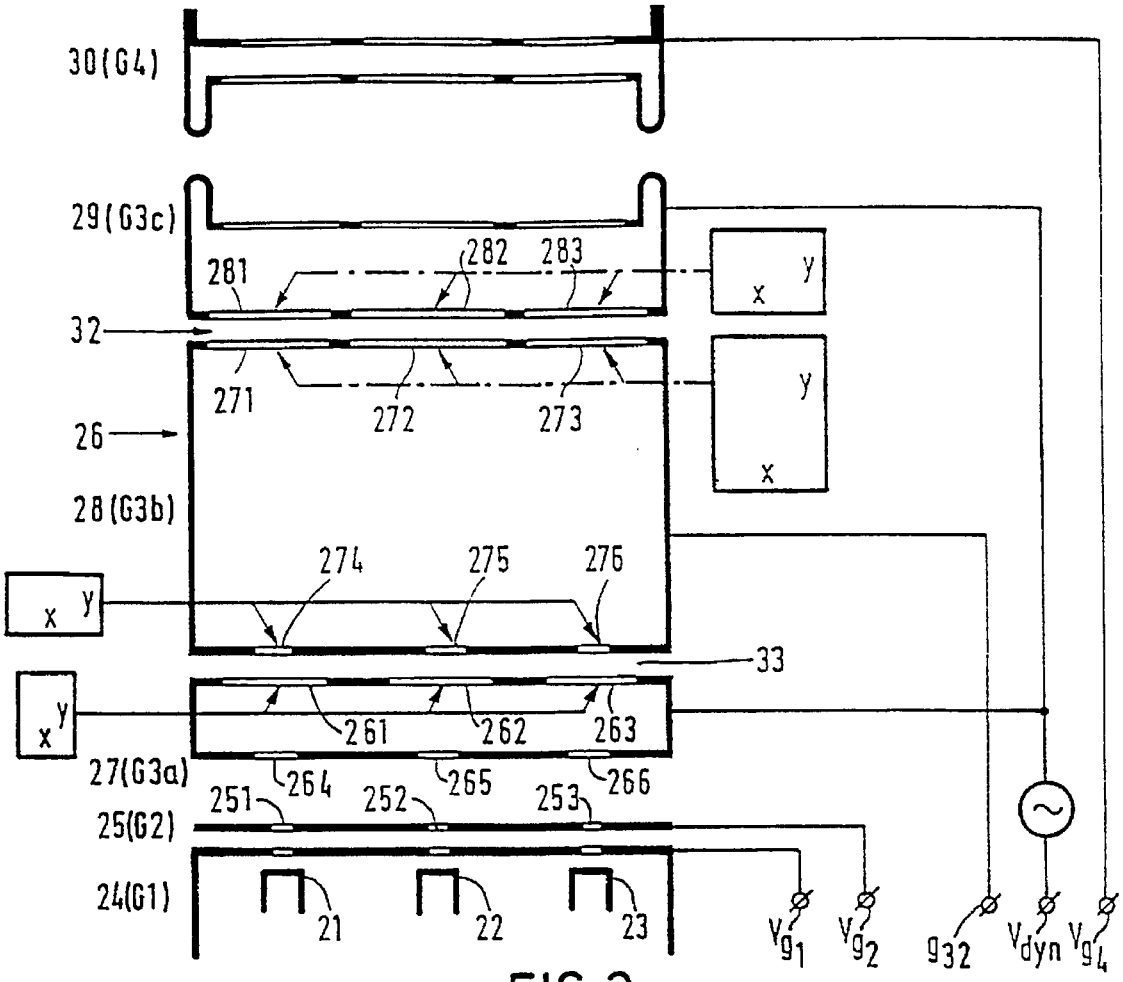
FIG. 3 is a schematic view of an electron gun for a display device in accordance with the invention.

FIG. 3 schematically shows an electron gun for a display device in accordance with the invention. The electrodes 27 ($G_{3a}$) and 29 ($G_{3c}$) are driven with the same dynamic voltage $V_{dyn}$, i.e. $V_{dyn} \equiv V'_{dyn}$. Preferably, the electrodes 27 and 29 are interconnected. The number of feedthroughs 16 is reduced by one, and the means 15 for generating voltages are simplified.

Preferably, the amplitude of the dynamic voltage $V_{dyn}$ is relatively small. As the amplitude of the dynamic voltage is made larger, a larger power supply is required. In addition, the losses and problems caused by capacitive coupling increase. They comply with $fCV^2$, wherein f is the frequency, C the capacitance and V the amplitude.

Figure 1:
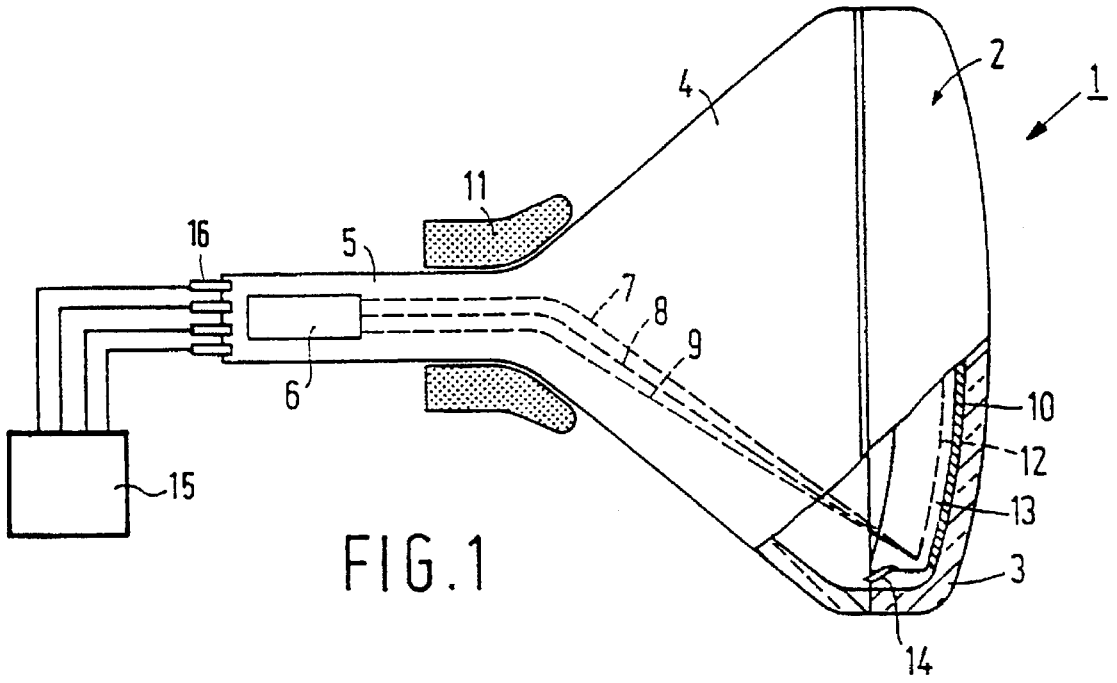
FIG. 1 is a sectional view of a display device.
Figure 4:
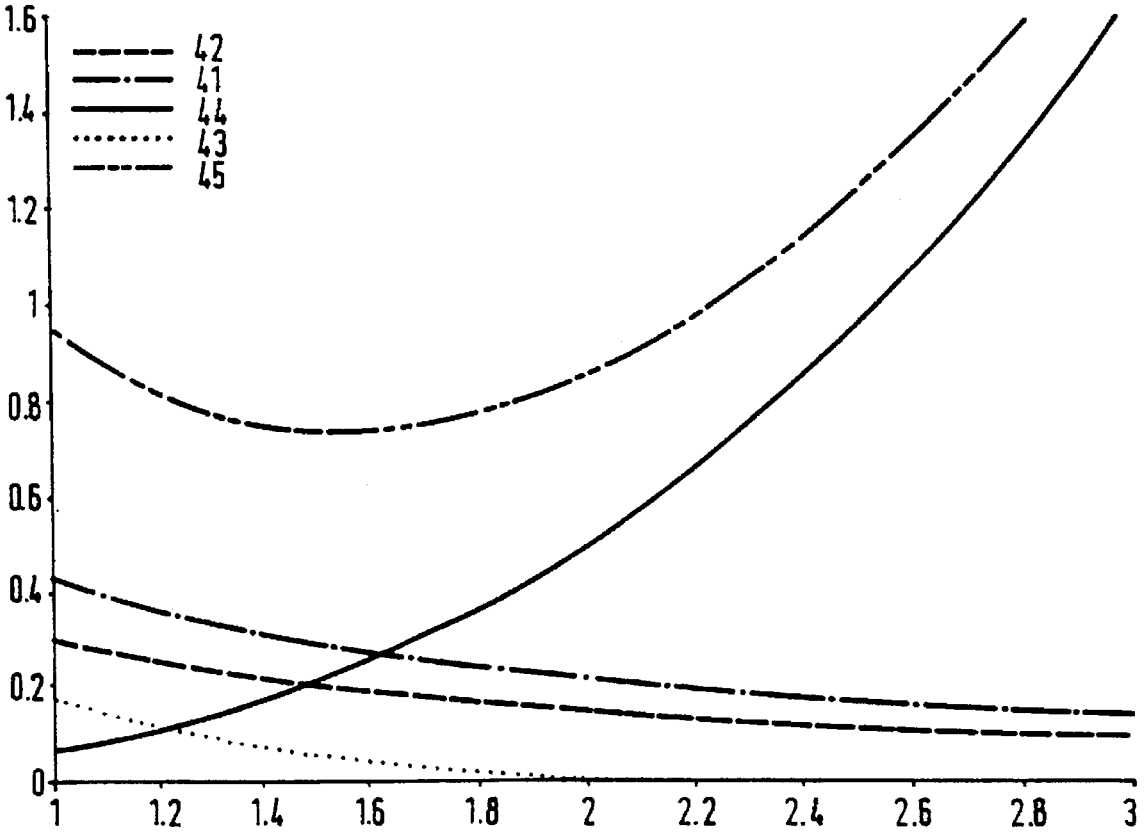
FIG. 4 shows the relationship between spot size and beam diameter.

A smaller amplitude of the dynamic voltage $V_{dyn}$ generally leads to a smaller effect on the vertical beam diameter. The vertical lens action can be intensified, so that said lower voltages can nevertheless be used to bring about an increase of the beam diameter, which is sufficient to compensate for the vertical spot shrinkage. In the horizontal direction, however, the beam diameter increases. However, the horizontal beam diameter may vary slightly without this leading to undesired spot growth. FIG. 4 shows, as a function of the beam diameter, the spot size on the display screen. The spot size on the display screen is governed by a number of factors, several of which (thermal effects, indicated by line 41, increase of the cross-over, indicated by line 42 and space-charge repulsion, indicated by line 43) decrease as the beam diameter increases, and the contribution of the spherical aberration (indicated by line 44) of the main lens increases as the beam diameter increases. The spot-size curve (line 45) is fairly flat at its minimum point, which means that the horizontal beam diameter may vary within certain limits without this having a noticeable negative effect on the spot size and thus on the picture reproduction.

Preferably, the variation of the beam diameter in the horizontal direction as a function of the dynamic voltage is maximally 60% and, preferably, between 20 and 60% of the variation of the beam diameter in the vertical direction, i.e.

$$-0.6 \leqq dBx/V_{dyn}: dBy/V_{dyn} \leqq 0 \text{ and, preferably,}$$

$$-0.6 \leqq dBx/V_{dyn}: dBy/V_{dyn} \leqq -0.2$$

For a simple round lens the ratio $dBx/V_{dyn}:dBy/V_{dyn}$ is 1 (equal action in the horizontal and vertical directions), for a true quadripolar lens said ratio is −1 (opposite action of equal magnitude in the horizontal and vertical directions) and for a true cylindrical lens without action in the x-direction said ratio is 0 (dBx=0). Therefore, in an electron gun in accordance with the invention use is preferably made in the pre-focusing portion of the electron gun of a dynamic lens which is a hybrid of a cylindrical lens and a quadripolar lens. A ratio in excess of 0.6 causes the horizontal spot size to vary so much that it noticeably adversely affects the picture reproduction, if the ratio is smaller than 0.2, there is a relatively small positive effect.

Some details of a preferred embodiment are shown in FIG. 3. The electrodes $G_{3a}$ and $G_{3b}$ are provided with rectangular apertures in the facing sides of these first and second sub-electrodes. The dimensions of the apertures are 0.6×1.2 mm. Preferably, the length-width ratio of these apertures is in excess of 1.5. The apertures in at least one of the electrodes $G_{3a}$ or $G_{3b}$ may constitute one large elongated aperture. The electrodes $G_2$ and $G_{3a}$ are provided with round apertures in the facing sides. This is a simple construction enabling a hybrid of a cylindrical lens and a quadripolar lens to be obtained.

It will be obvious that within the scope of the invention many variations are possible. For example, the embodiments show an electron gun whose pre-focusing portion consists of three electrodes (G1-G2-$G_{3a}$). It is alternatively possible that the pre-focusing portion of the electron gun consists of more than three electrodes, for example the following arrangement: G1-G2-G3-G4-G5, wherein G5 is divided into a first, second and third sub-electrode ($G_{5a}$, $G_{5b}$, $G_{5c}$), and wherein the electrodes G2 and G4 are interconnected and the electrodes G3 and $G_{5a}$ and $G_{5c}$ are interconnected and driven by means of one dynamic voltage, and the focusing voltage is applied to electrode $G_{5b}$. Such an arrangement, too, enables a hybrid of a cylindrical lens and a quadripolar lens to be obtained in the pre-focusing portion of the electron gun.

Figure 5:
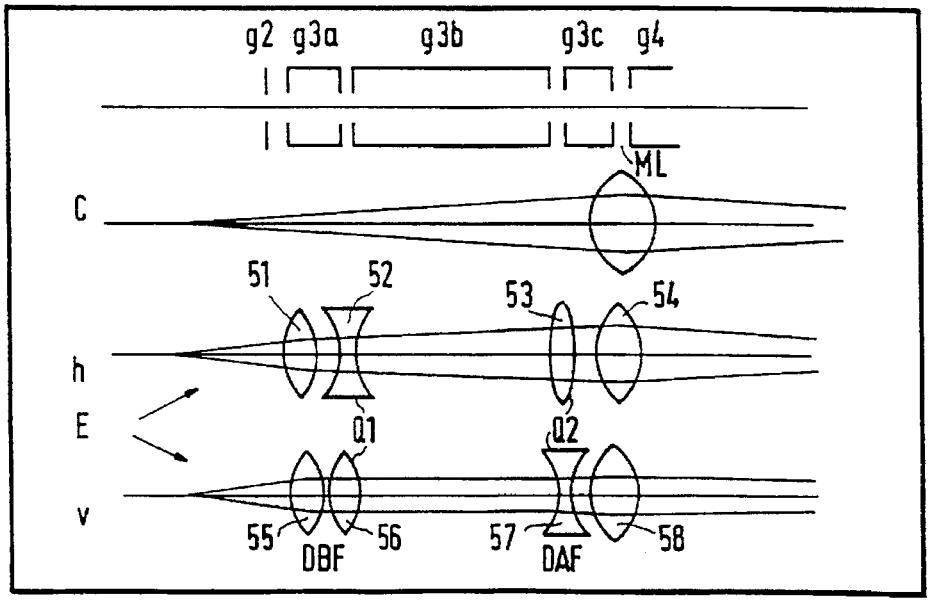
FIG. 5 schematically shows the lenses and the lens action.

FIG. 5 shows, by way of example, the different lenses in an electron gun which can suitably be used in an embodiment of a display device in accordance with the invention. For clarity, the lens in G2 is left out. The Figure shows the main lens (ML=main lens), the dynamic quadripolar lens formed between G3*b* and G3*c* (Q2), the dynamic quadripolar lens formed between G3*b* and G3*a* (Q1) and the dynamic lens formed between G3*a* and G2. In the centre (i.e. for an undeflected electron beam), indicated by line C, the intensity of the dynamic lenses is zero. Thus, the electron beam is influenced only by the main lens (ML). At the end of the longitudinal axis (E=East), there is indicated the lens action of the different lenses in the horizontal direction (h) and in the vertical direction (v). The lens actions (51) (of the lens between G2 and G3*a*) and 52 (of the lens between G3*a* and G3*b*) oppose each other (one lens is positive and the other negative), the lens actions 55 and 56 intensify each other. If the lens actions 51 and 52 are exactly equal in intensity yet of opposite sign, then the dynamic lens formed by the electrodes G2-G3*a*-G3*b* is a cylindrical lens because there is no lens action in the horizontal direction but there is in the vertical direction. In a display device in accordance with the invention, the DBF lens, i.e. the assembly of the dynamic lens G2-G3*a* and the dynamic lens G3*a*-G3*b*, is a hybrid of a cylindrical lens and a quadripolar lens; in the example illustrated in FIG. 5, this assembly has a divergent effect in the horizontal direction and a convergent effect in the vertical direction, the intensity of the lens in the horizontal direction being much smaller than in the vertical direction, but greater than zero. The intensities of the main lens (ML) and the quadripolar lens Q2 between G3*b* and G3*c* can be dynamically varied by applying a dynamic voltage to G3*c*. This results in the formation of a so-called DAF (Dynamic Astigmatism and Focus) lens. The intensity of the quadripolar lens Q2 is schematically indicated by lens 53 (horizontal direction) and lens 57 (vertical direction). The intensity of the main lens (ML) is indicated by lenses 54 and 58.

I claim:

1. A display device comprising: a cathode ray tube which comprises a display screen and a deflection unit for deflecting electron beams, the cathode ray tube including an in-line electron gun for generating three electron beams, said in-line electron gun comprising a main lens portion having means for generating a main lens field and a quadripolar field, and the electron gun has means for generating, in front of the main lens field, a pre-focusing lens field and a further quadripolar field, and the display device includes means for dynamically varying the intensity of the main lens field, the quadripolar field, the pre-focusing lens field and the further quadripolar field such that, in operation, the intensity of said four fields is dynamically varied by means of only one dynamic voltage, and wherein the combined dynamic lens action of the combination of the dynamic pre-focusing lens and the further quadripolar lens causes a dynamic change in beam diameter in both vertical (dBy) and horizontal (dBx) directions with the change in the horizontal direction being opposite to the change in the vertical direction, and the ratio dBx/dBy lies between 0.6 and 0.2.

2. A display device as claimed in claim 1, wherein the amplitude of the one dynamic voltage ranges between approximately 500 volts and 200 volts.

3. A display device comprising: a cathode ray tube which comprises a display screen and a deflection unit for deflecting electron beams, the cathode ray tube including an in-line electron gun for generating three electron beams, said in-line electron gun comprising a main lens portion having means for generating a main lens field and a quadripolar field, and the electron gun has means for generating, in front of the main lens field, a pre-focusing lens field and a further quadripolar field, and the display device includes means for dynamically varying the intensity of the main lens field, the quadripolar field, the pre-focusing lens field and the further quadripolar field such that, in operation, the intensity of said four fields is dynamically varied by means of only one dynamic voltage, and wherein the ratio of the quotient of the change of the beam diameter in the horizontal direction (dBx) as a function of the dynamic voltage ($V_{dyn}$) to the quotient of the change of the beam diameter in the vertical direction (dBy) as a function of the dynamic voltage, due to the combined action of the pre-focusing field and the further quadripolar field, complies with:

$$-0.6 \leqq dBx/V_{dyn};\ dBy/V_{dyn} \leqq -0.2.$$

4. A cathode ray tube comprising: an in-line electron gun which includes three cathodes, a first ($G_1$), second ($G_2$), third ($G_3$) and a fourth electrode ($G_4$), the third electrode comprising a first, a second and a third sub-electrode ($G_{3a}$, $G_{3b}$, $G_{3c}$), a main lens being formed between the fourth electrode ($G_4$) and the third sub-electrode ($G_{3c}$), a quadripolar lens being formed between the third sub-electrode ($G_{3c}$) and the second sub-electrode ($G_{3b}$), a further quadripolar lens being formed between the second sub-electrode ($G_{3b}$) and the first sub-electrode ($G_{3a}$), and a pre-focusing lens being formed by the first sub-electrode ($G_{3a}$), the second electrode ($G_2$) and the first electrode ($G_1$), and means for applying only one dynamic voltage to the first and third sub-electrodes and a focusing voltage to the second sub-electrode, and wherein the ratio of the quotient of the change of the beam diameter in the horizontal direction (dBx) as a function of the dynamic voltage ($V_{dyn}$) to the quotient of the change of the beam diameter in the vertical direction (dBy) as a function of the dynamic voltage, due to the combined action of the pre-focusing field and the further quadripolar field, complies with:

$$-0.6 \leqq dBx/V_{dyn};\ dBy/V_{dyn} \leqq -0.2.$$

5. A cathode ray tube as claimed in claim 1, wherein the facing sides of the first and second sub-electrodes are provided with rectangular apertures, the length:width ratio of said apertures being greater than 1.5.

6. A cathode ray tube as claimed in claim 1, wherein the first and third sub-electrodes are interconnected.

7. A display device comprising:

a cathode ray tube including an electron gun for generating three electron beams, a display screen and a color selection electrode, a deflection unit mounted on said cathode ray tube, wherein said electron gun comprises plural cathode elements, electrode means arranged to form a main lens to derive a main lens field, a quadripole lens to derive a quadripolar field and a dynamic compound lens and which are positioned in the order named between the color selection electrode and said plural cathode elements, said dynamic compound lens producing a prefocussing field and a further quadripolar field and comprising first, second and third apertured electrodes arranged in sequence between the cathodes and the color selection electrode as to form a prefocus lens and a further quadripolar lens for producing said prefocussing field and said further quadripolar field, and said third electrode comprises first and second juxtaposed sub-electrodes with facing apertured surfaces of the first and second sub-electrodes having rectangular apertures with a length-to-width ratio of at least 1.5, means for supplying operating voltages to said electrode means for producing said fields, and means for applying a single dynamic voltage to a portion of said electrode means so as to dynamically vary the intensity of the main lens field, the quadripolar field, the prefocussing field and the further quadripolar field.

8. The display device as claimed in claim 7 wherein said electrode means further comprises;

a fourth apertured electrode between the third apertured electrode and the color selection electrode and wherein the third electrode comprises first, second and third apertured sub-electrodes arranged in sequence, and wherein the main lens comprises the fourth electrode and the third sub-electrode, the quadripole lens comprises the third and second sub-electrodes of the third electrode, the further quadripolar lens comprises the second and first apertured sub-electrodes of the third electrode, the prefocussing lens comprises the first sub-electrode, the second electrode and the first electrode, and said means for applying a single dynamic voltage applies the same dynamic voltage to the first and third sub-electrodes of the third electrode.

9. The display device as claimed in claim 8 wherein said first and third sub-electrodes are interconnected to a terminal for applying said single dynamic voltage to the first and third sub-electrodes of the third electrode.

10. The display device as claimed in claim 8 wherein said means for supplying operating voltages supplies a focussing voltage to the second sub-electrode of the third electrode.

11. The display device as claimed in claim 7 wherein said third electrode further comprises a third sub-electrode juxtaposed to said second sub-electrode with a facing apertured surface of at least one of the second and third sub-electrodes having a rectangular aperture.

12. The display device as claimed in claim 7 wherein the second electrode and the first sub-electrode of the third electrode are juxtaposed with facing surfaces having round apertures therein.

13. The display device as claimed in claim 7 wherein the single dynamic voltage operates, by way of the further quadripolar lens, to change the beam diameter oppositely in the horizontal and vertical direction, while the pre-focusing lens changes the beam diameter in the same direction for both the horizontal and vertical directions, the combined effect being such that the change in the vertical and horizontal beam dimension are of opposite sign.

14. A display device comprising:

a cathode ray tube including an electron gun for generating three electron beams, a display screen and a color selection electrode, a deflection unit mounted on said cathode ray tube, wherein said electron gun comprises plural cathode elements, electrode means arranged to form a main lens to derive a main lens field, a quadripole lens to derive a quadripolar field and a dynamic compound lens and which are positioned in the order named between the color selection electrode and said plural cathode elements, said dynamic compound lens producing a prefocussing field and a further quadripolar field, means for supplying operating voltages to said electrode means for producing said fields, and means for applying a single dynamic voltage to a portion of said electrode means so as to dynamically vary the intensity of the main lens field, the quadripolar field, the prefocussing field and the further quadripolar field, and wherein said means for applying a single dynamic voltage controls the dynamic compound lens so that for the dynamic compound lens the ratio of the quotient of the change of the beam diameter in the horizontal direction (dBx) as a function of the dynamic voltage ($V_{dyn}$) to the quotient of the change of the beam diameter in the vertical direction (dBy) as a function of the dynamic voltage complies with:

$$-0.6 \leqq dBx/V_{dyn} : dBY/V_{dyn} \leqq -0.2.$$

15. A display device comprising:

a cathode ray tube including an electron gun for generating three electron beams, a display screen and a color selection electrode, a deflection unit mounted on said cathode ray tube, wherein said electron gun comprises plural cathode elements, electrode means arranged to form a main lens to derive a main lens field, a quadripole lens to derive a quadripolar field and a dynamic compound lens and which are positioned in the order named between the color selection electrode and said plural cathode elements, said dynamic compound lens producing a prefocussing field and a further quadripolar field, means for supplying operating voltages to said electrode means for producing said fields, means for applying a single dynamic voltage to a portion of said electrode means so as to dynamically vary the intensity of the main lens field, the quadripolar field, the prefocussing field and the further quadripolar field, and wherein; said single dynamic voltage varies as a function of the deflection angle of the electron beams, the variation of the electron beam diameter in the horizontal direction as a function of the dynamic voltage is between 20% and 60% of the variation of the beam diameter in the vertical direction, and the dynamic compound lens is a hybrid of a cylindrical lens and a quadripolar lens.

* * * * *